United States Patent [19]

Collins

[11] Patent Number: 4,805,819

[45] Date of Patent: Feb. 21, 1989

[54] SHEATH FOR A RETRACTABLE KNIFE

[75] Inventor: Walter L. Collins, North, S.C.

[73] Assignee: Gerber Legendary Blades, Inc., Portland, Oreg.

[21] Appl. No.: 141,932

[22] Filed: Jan. 4, 1988

[51] Int. Cl.[4] ..... B26B 29/02

[52] U.S. Cl. ..... 224/232; 224/240; 224/245; 224/904; 30/151

[58] Field of Search ..... 224/182, 199, 223, 226, 224/227, 232, 233, 235, 241, 242, 245, 252, 269, 904, 191, 195, 234, 236, 237, 238, 239, 240, 253, 268, 914; 30/143, 151

[56] References Cited

U.S. PATENT DOCUMENTS

| | | | |
|---|---|---|---|
| 1,504,927 | 10/1922 | Baust | 224/232 |
| 2,387,900 | 12/1944 | Hartwell | 224/232 |
| 3,130,883 | 3/1962 | MacKool | 224/234 |
| 4,690,315 | 9/1987 | Bianchi | 224/252 |

*Primary Examiner*—Henry J. Recla
*Assistant Examiner*—Robert Fetsuga
*Attorney, Agent, or Firm*—Foley & Lardner

[57] ABSTRACT

A sheath for housing a retractable knife both in its retracted or unretracted state provided with a pair of pockets, one adapted to receive the knife blade and a second adapted to receive the knife when the blade is housed within its handle, and additionally capable of being folded into a more compact form when housing a retracted knife.

12 Claims, 2 Drawing Sheets

SHEATH FOR A RETRACTABLE KNIFE

BACKGROUND OF THE INVENTION

This invention relates to a sheath for carrying a retractable tool mechanism such as a knife which has a blade that can be retracted into its handle.

Retractable knives of the type commercially available have proven to be extremely popular with hunters and the outdoorsmen. The knives generally have a handle capable of receiving the entire blade in a locked position. Depending upon the circumstances, it may be desirable to carry such knives in the folded position. Yet sheaths adapted for use with knives either fixed or locked open have not generally proven to be satisfactory for use with knives in a folded position and vice versa. It would be highly desirable to have a sheath capable of fulfilling both functions without being bulky and providing other undesirable disadvantages.

SUMMARY OF THE INVENTION

The sheath of the present invention has the ability to house a retractable knife both in its retracted or unretracted state. The sheath is provided with a pair of pockets, one adapted to receive the knife blade and a second adapted to receive the knife when the blade is housed within its handle. The sheath is additionally capable of being folded into a more compact form when housing a retracted knife. Additionally, the sheath is provided with elements capable of being fastened to a person's belt in either the sheath's extended or folded position.

BRIEF DESCRIPTION OF THE DRAWING

A preferred exemplary embodiment of the present invention will hereinafter be described wherein like numerals denote like elements and.

DETAILED DESCRIPTION OF THE INVENTION

Figure 1:
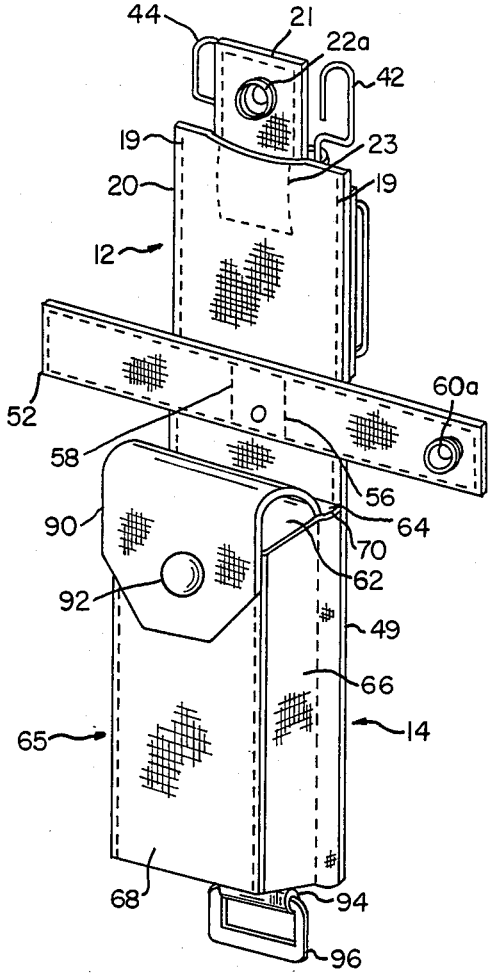
FIG. 1 is a perspective view of the front of a sheath in accordance with the present invention.

As best seen in FIG. 1, a sheath in accordance with the present invention is depicted generally by reference numeral 10. The materials comprising sheath 10 must necessarily be durable and rugged. A preferred suitable fabric is commercially available under the name of Cordura, a registered trademark of the E. I. DuPont Company. The seams of sheath 10 are generally stitched together by heavy nylon thread. When stiffness is a desirable attribute for portions of the sheath, any one of various hard rubber materials may be incorporated into the fabric as a backing.

Figure 3:
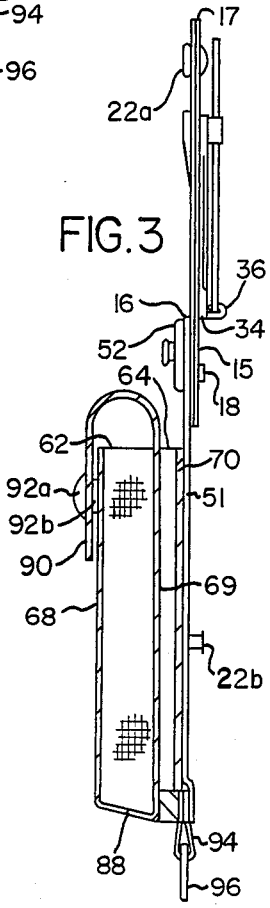
FIG. 3 is a side sectional view of the sheath in FIG. 2.

Sheath 10 is depicted in the various views of FIGS. 1 and 3 in an extended relationship and is comprised of an upper support 12 and a lower support 14 each having respective tab extensions 15 and 16 overlapping and pivotably secured together by a pivot rivet fastener 18. Referring first to support 12, which has a generally rectangular upper section 20 terminating at its lower end in tab 15. Stiffness is added to section 12 and tab 15 by hard rubber core 17 sewn within the fabric along peripherally located stitched seams indicated by dashed lines 19.

A flexible strap 21 of folded fabric is stitched along seam 23 and secured to the top central edge of upper section 20. Strap 21 is provided with a female member **22*a*** of a lift-to-dot snap fastener, the function of which will be described below.

Figure 4:
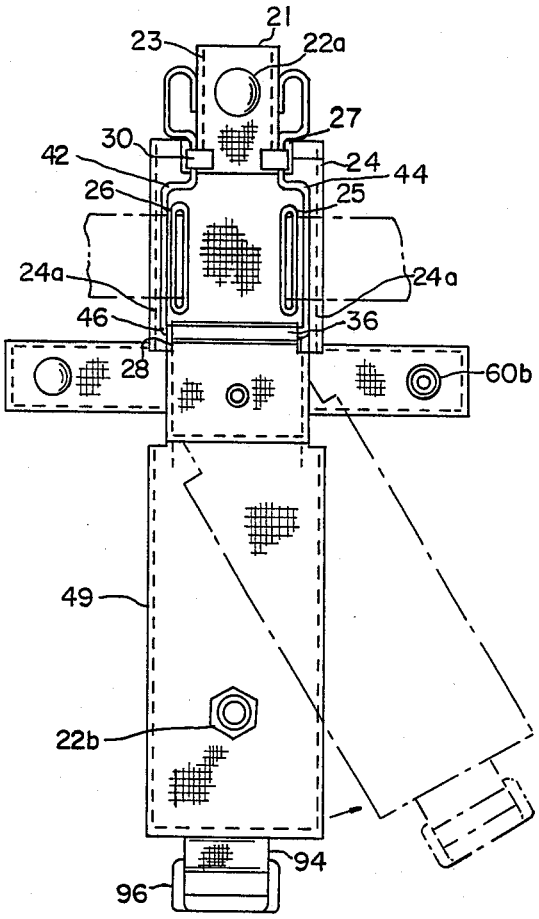
FIG. 4 is a back elevation view of the sheath with the bottom section shown slightly pivoted in dashed lines.

As seen in FIG. 4, belt member 24 is secured to SEction 20 on the reverse side thereof by stitched line **24*a*. Belt member 24 has a pair of space slots 25 and 26 adapted to receive a belt worn by the user of the sheath and a pair of cut out openings 27, 28 along the top and lower edges, respectively. A plate 34, positioned between member 24 and upper section 36 positioned within the space formed by opening 28 and a pair of spaced folded arms 38, 40 extending outwardly therefrom through opening 27 of plate 34. The terminal ends of arms 38 and 40 are folded toward one another and defining a gap. Plate 34 is immobilized within the space defined between section 20 and member 24 by the abutment of hinge 36 and arms 38, 40 against the respective edges of cutout portions 27 and 28. A U-shaped member formed by two flexible legs 42 and 44 and transverse connecting member 46 is mounted within hinge 36 for pivotal movement relative to plate 34. When pivoted upwardly, legs 42 and 44 can be pinched inwardly to fit within the gap formed between arms 38, 40 and behind the folded tips thereof to be securely retained in a fastened position as shown in FIG. 4**. Such fasteners known as Bianchi-type fasteners facilitate rapid attachment to or removal from a belt of a user.

Lower support 49, like upper support 20, has added stiffness by the incorporation therein of hard rubber core member 51. A flexible fastening strap 52 is secured directly to tab 16 by rivet fastener 18 and stitched along spaced lines 56, 58 to section 49 to prevent relative motion therebetween. The ends of strap 52 are each provided with button type fasteners **60*a*, 60*b*** which are used in a manner to be described.

Figure 2:
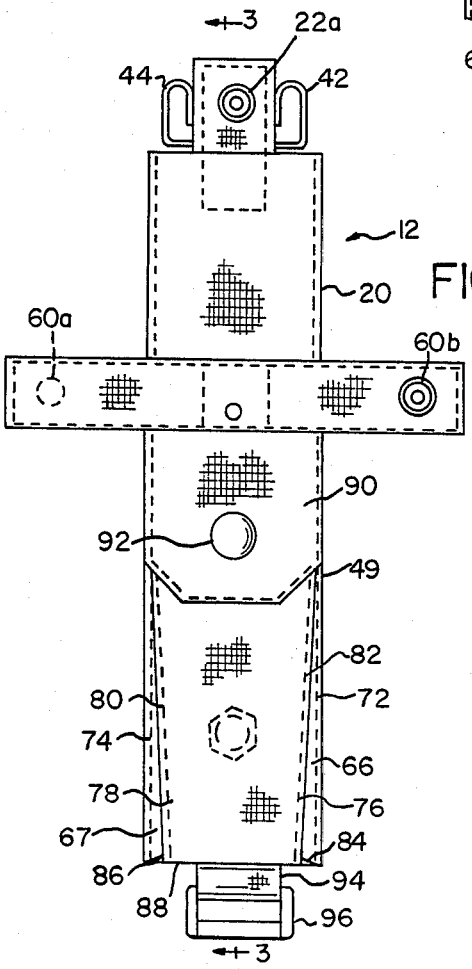
FIG. 2 is a front elevation view of the sheath in FIG. 1.

A pair of pouches shown generally as 62 and 64 are formed by a weld 70 having a U-shaped configuration positioned against a surface of support 49 along the vertical and bottom edges thereof, and a single unitary cover member 65 comprising a pair of side panels 66, 67 and a front panel 68. A partitioning panel 69 is positioned against the front edges of welt 70 and extends beyond the mouth of pocket 62 forming a flap 90. Side panels 66, 67 are tightly folded aroung the outer edges of welt 70 and extend between the surface 49 and the inside surface of welt 70 and over the edges of partitioning panel 69. Side panels and welt 70 are secured to support 14 along stitch lines 72, 74 as best depicted in FIG. 4. As illustrated in FIG. 2, side panels 66, 67 are secured to partition panel 69 and welt 70 respectively along stitch lines 76, 78. Overlapping stitch lines 80, 82 form member 65 into panels 66, 67 and 68 providing a generally parallel piped appearance. The fabric is additionally inwardly folded and stitched, along lines 84, 86 to form bottom 88. As perhaps best seen in the front views afforded by FIGS. 2 and 5, the pocket 64 narrows toward bottom 88.

Flap 90 is provided with bottom type fastener element 92 which is complimentary to a fastener element (not shown) positioned on the upper central region of front panel 68. Extending from and stitched to the bottom of support 14 between the issuer surface thereof and weld 70 is a loop 94 supporting a hard rubber buckle 96 which, when secured to a belt attached to the lower garment of a user, serves to minimize motion delivered to the extended sheath 10 due to body movement.

Figure 6:
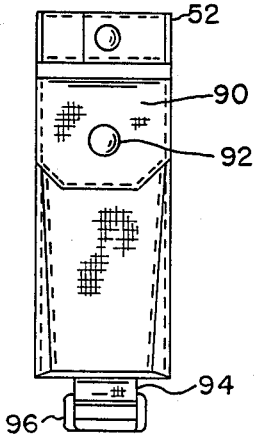
FIG. 6 is a front view of the sheath showing it in a folded position.
Figure 7:
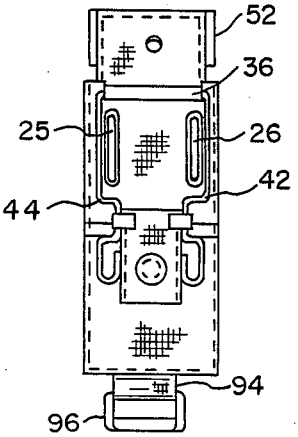
FIG. 7 is a back view of the sheath showing it in a folded position.

As best seen in FIG. 4, 6 and 7, sheath 10 may be used either in an "open" or a "closed" position. The closed position occurs when male portion 22*b* of fastener 22 located on the back side of section 14 is in registry with the female position 22*a*. In such position, section 12 is juxtaposed to and in axial alignment with section 14. Conversely, when upper section 12 is fully extended from and axial alignment with lower section 14, sheath 10 is in an open position.

Figure 5:
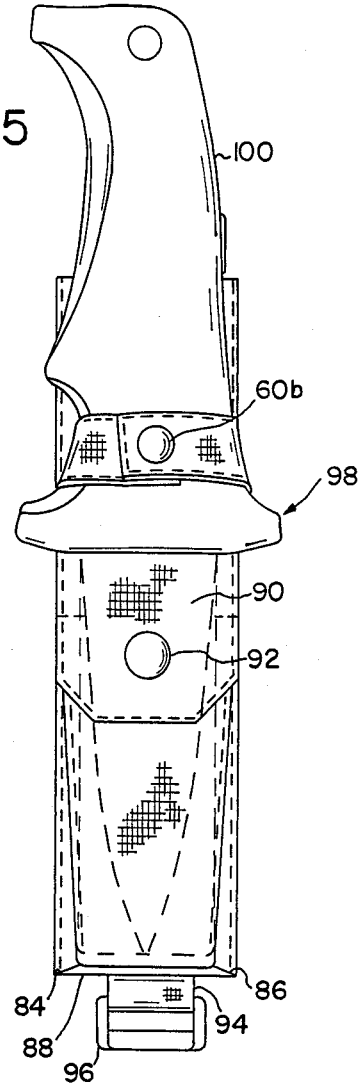
FIG. 5 is a front view of the sheath depicting an unretracted knife housed within the sheat.

When it is desired to carry an unretracted knife 98 in a manner indicated in FIG. 5, sheath 10 is placed in an open position and blade 102 of knife 100 is inserted into the narrow confines of pouch 64. Strap 52 then may be placed around the handle 100 of the unretracted knife 98 with snap fasteners 60*a* and 60*b* secured together. This is demonstrated in FIG. 5 showing a knife 98 with its blade 102 positioned within pouch 64. Welt member 70, shown in the dashed lines in FIG. 5, provides a cut-preventing surface for the blade 102 of knife 98. Sheath 10 then may be attached to a belt of the user through the insertion of a belt through slots 25 and 26 or, alternatively, sheath 10 may be attached by inserting the unsecured legs 42, 44 behind the belt and securing the ends thereof by the tips of arms 38 and 40. Additionally, pouch 64 may be employed to store other items and accessories with flap 90 secured thereto by fastener elements 92*a*, 92*b*.

If, however, it is desired to house, for example, a knife in its retracted or folded position as shown in FIGS. 6 and 7, the entire knife may be inserted into pouch 62 and upper sheath member 12 when rotated about rivet 18 behind lower sheath member 14 and fastened by snap element 22*a* to snap element 22*b*. Again, as in the open position, the sheath 10 may be secured to the belt of a user by the use of slots 25, 26, or by the insertion of legs 42, 44 behind the belt of the user as in the open position. Because fastener 22 is a lift-to-dot type snap fastener, it resists opening from any forces caused by, for example, movement of the user's body. The fastener responds only by the lifting of strap 21. Strap 52 may be secured by snapping the fastener elements 60*a* and 60*b* together.

It will be understood that the foregoing description if os a preferred embodiment of the present invention and is not limimted to the specific forms shown. Modifications may be made in the design and arrangement of the element within the scope of the present invention as expressed in the appended claims.

I claim:

1. A sheath for use with a retractable tool comprising (a) a first elongated sheath section including means for securing said first sheath section to an article of clothing worn by a user and (b) a second elongated sheath section having one end pivotably connected to one end of said first section and having a receiving means capable of housing a tool portion of an unretracted tool when said first and second sections are in a first alignment extending away from each other and housing a retracted tool when said sections are in a second alignment overlapping each other.

2. The sheath of claim 1 in which said receiving means includes a first pocket for receiving said tool portion and a second pocket for receiving said retracted tool.

3. The sheath of claim 2 in which said pockets are open at their tops when said sections are in said first alignment and share a common partition wall.

4. The sheath of claim 3 in which said common wall extends out beyond the opening of said pockets and is adapted to be fastened to the outside of another wall of one of said pockets thereby enclosing one of said pockets.

5. The sheath of claim 2 including a fastening means for fastening said first and second sections together when in said second alignment, said fastening means including a first element positioned on said first section and a second element positioned on said second section, said first and second elements in registry when said first section is juxtaposed and in axial alignment with said second section.

6. The sheath of claim 2 securing means comprises a pair of spaced slots capable of receiving a belt of a user.

7. The sheath of claim 2 in which said securing means comprises a Bianchi-type fastener adapted to fasten around a belt of a user.

8. The sheath of claim 2 in which said securing means comprises both a pair of spaced slots capable of receiving a belt of a user and a Bianchi-type fastener adapted to be fastened around the belt.

9. The sheath of claim 8 in which said first sheath section comprises a backing cover and a belt member secured along one pair of edges to said backing cover and defining a space therebetween, said belt member having said pair of spaced slots for receiving a belt.

10. The sheath of claim 9 including a flexible strap adapted to be fastened around a handle of an unretracted tool.

11. The sheath of claim 9 in which said first packet in lined with a cut resistant material adapted to be in contact with cutting edge of unretracted tool housed within said first packet.

12. The sheath claim 9 including a strap means for securing a handle of said tool portion when said first and second sections are in said first alignment.

* * * * *